US012654892B2

(12) United States Patent
Benetti

(10) Patent No.: US 12,654,892 B2
(45) Date of Patent: Jun. 16, 2026

(54) AUTOMATIC DEVICE FOR STRAPPING BALES IN FIBROUS MATERIAL AND AUTOMATIC METHOD FOR STRAPPING BALES IN FIBROUS MATERIAL

(71) Applicant: ITIPACK SRL, Villaverla (IT)

(72) Inventor: Bruno Benetti, Villaverla (IT)

(73) Assignee: ITIPACK SRL, Villaverla (IT)

( * ) Notice: Subject to any disclaimer, the term of this patent is extended or adjusted under 35 U.S.C. 154(b) by 268 days.

(21) Appl. No.: 18/688,142

(22) PCT Filed: Dec. 21, 2022

(86) PCT No.: PCT/IB2022/062622

§ 371 (c)(1),
(2) Date: Feb. 29, 2024

(87) PCT Pub. No.: WO2023/119192

PCT Pub. Date: Jun. 29, 2023

(65) Prior Publication Data

US 2025/0121969 A1 Apr. 17, 2025

(30) Foreign Application Priority Data

Dec. 23, 2021 (IT) ..... 102021000032375

(51) Int. Cl.
*B65B 27/12* (2006.01)
*B65B 13/04* (2006.01)
*B65B 13/32* (2006.01)

(52) U.S. Cl.
CPC ..... *B65B 27/12* (2013.01); *B65B 13/04* (2013.01); *B65B 13/32* (2013.01)

(58) Field of Classification Search
CPC ..... B65B 13/02; B65B 13/04; B65B 13/06; B65B 13/32; B65B 27/12; A01F 15/12
See application file for complete search history.

(56) References Cited

U.S. PATENT DOCUMENTS

| | | | | |
|---|---|---|---|---|
| 4,611,534 | A | 9/1986 | Kudlicka et al. | |
| 5,826,499 | A * | 10/1998 | Bullington | B65B 27/12 100/26 |
| 6,536,336 | B1 | 3/2003 | Jaenson et al. | |
| 6,705,214 | B1 * | 3/2004 | Stamps | B65B 27/12 100/14 |
| 7,127,986 | B2 * | 10/2006 | Daniel | B65B 27/12 53/589 |
| 2005/0109225 | A1 | 5/2005 | Daniel et al. | |
| 2012/0017780 | A1 * | 1/2012 | Haberstroh | B65B 27/12 100/20 |

OTHER PUBLICATIONS

International Search Report and Written Opinion dated Mar. 30, 2023, issued in PCT Application No. PCT/IB2022/062622, filed Dec. 21, 2022.

* cited by examiner

*Primary Examiner* — Jimmy T Nguyen
(74) *Attorney, Agent, or Firm* — Workman Nydegger

(57) ABSTRACT

An automatic device for strapping bales in fibrous material, preferably in cotton, configured to tie a plurality of straps around a bale formed and pressed by a bale press. The device includes: a launching and welding assembly adapted to be arranged at a first side of the press and configured to launch a plurality of straps around the bale; a rear assembly adapted to be arranged at a second side of the press so as to define a strapping path around the bale; a feeding assembly configured to feed with a plurality of portions of straps the launching and welding assembly.

16 Claims, 16 Drawing Sheets

AUTOMATIC DEVICE FOR STRAPPING BALES IN FIBROUS MATERIAL AND AUTOMATIC METHOD FOR STRAPPING BALES IN FIBROUS MATERIAL

BACKGROUND OF THE INVENTION

1. The Field of the Invention

The present invention relates to an automatic device for strapping bales in fibrous material, preferably in cotton, configured to tie a plurality of straps around a bale formed and pressed by a bale press.

Furthermore, the invention also concerns a system for making bales in fibrous material, in particular in cotton, comprising a press for bales in fibrous material associated with the aforesaid automatic strapping device.

The invention also concerns an automatic method for strapping bales in fibrous material, preferably in cotton, by means of said automatic strapping device.

2. The Relevant Technology

The Relevant TechnologyIt is known that in order to be able to maintain the compact shape of a bale in fibrous material, in particular in cotton, pressed by means of a press, it is necessary to wind the aforesaid pressed bale with a plurality of bands, also called "straps", either metallic or plastic, and closed in a loop, so as to limit the natural expansion of the fibrous material.

This is in order to limit the volume occupied by each of the bales, especially in order to be able to facilitate and optimize their transport by land, air or naval vehicles and in order to facilitate and optimize their storage in special warehouses.

It is also well known that historically, in the sector of cotton or, in general, of the fibrous material, a manual method was and still is used for tying/strapping cotton bales, according to which some human operators manually wind one or more straps around a pressed cotton bale and secure the overlapped ends of each strap appropriately, depending on the tensioning that is intended to be reached.

In fact, as mentioned above, when the bale is released from the pressing plates of the press, the material with which the same bale is made tends to expand, therefore placing these straps in tension, consequently limiting the expansion of the material itself.

Alternatively, according to the prior art, such straps could be wound around the pressed bales and tied by means of automatic strapping devices, operatively coupled to a bale press.

In particular, a first type of such strapping devices of the prior art could provide a launching and welding assembly arranged at one side of a press and comprising several launching and welding heads which, in collaboration with a rear assembly, arranged on the opposite side of the press with respect to said first side, allow to wind a plurality of straps around the cotton bale, where, for each strap, said launching and welding assembly is able to weld the overlapped ends thereof, possibly after recovery of part of the strap, so as to adjust the length of the latter, depending on the tensioning degree that is intended to be obtained.

This can be implemented through two possible alternative solutions, both of which suffer from significant drawbacks.

According to a first solution, this type of devices requires, for each of the launching and welding heads, a dedicated feeding assembly, able both to supply the aforesaid launching and welding head with the strap to be wound around the pressed cotton bale, and to recover the same strap in the opposite direction before welding, so as to adjust its length and therefore its tensioning degree.

In this case, therefore, disadvantageously, this type of strapping devices has a large number of components, in particular each launching and welding head must be equipped with its own strap feeding assembly. Thus, disadvantageously, such types of devices have substantial and not negligible structural complexity.

Alternatively, according to the second solution, the aforesaid strapping devices could provide, upstream of the plurality of launching and welding heads, a single feeding assembly capable of feeding and recovering the strap selectively at each of the aforesaid launching and welding heads.

In this case, disadvantageously, although the structure of the device is less complex than the previous case, the launch and the recovery in the opposite direction of the straps cannot take place simultaneously for all the launching and welding heads, but they can necessarily be performed at a single launching and welding head at a time, and exclusively at the end of the bale pressing operation. This, disadvantageously, results in an increase in the overall times to perform such strapping and, at the same time, results in the impossibility of actively exploiting the time interval during which the pressing operation is performed by the press.

A different solution of strapping devices of the prior art, which has been devised for the purpose of overcoming the drawbacks just described, provides that each launching and welding head is supplied with a portion of strap of predefined and unchangeable length. In particular, said portion of strap is supplied to each of the launching and welding heads, during the pressing operation of the cotton bale.

Therefore, once the pressing is finished, each of the aforesaid launching and welding heads, by means of suitable mechanical movements, and simultaneously with the remaining launching and welding heads, is able to wind the aforesaid portion of strap around the cotton bale, and weld the ends thereof.

Thus, in this case a single feeding assembly could be provided capable of sequentially supplying each of the launching and welding heads with a specific portion of strap during the pressing operation, and moreover this second type of devices of the prior art is able to perform the winding and the welding of the plurality of portion of straps simultaneously at the end of the pressing operation.

However, disadvantageously, such devices of the prior art are not configured to allow each launching and welding head to handle portions of straps of different and variable lengths. In other words, each of the launching and welding heads is mechanically defined so as to be able to handle the winding and the welding of a portion of strap of predefined and fixed length, and, at the same time, the particular configuration and collaboration between the launching and welding assembly and the feeding assembly do not allow to recover the strap as a result of its winding around the pressed bale.

Therefore, disadvantageously, with such devices it is not possible to choose and adjust from time to time and for each launching and welding head the appropriate length of the strap for the single head, unless by mechanically intervening on the structure of the launching and welding assembly.

SUMMARY OF THE INVENTION

Therefore, it is the task of the present invention to develop an automatic strapping device capable of overcoming the aforesaid drawbacks and limitations of the prior art. In particular, aim of the invention is to realize an automatic device for strapping bales in fibrous material, preferably in cotton, which allows to modify, between one strapping process and the next, in a simple and quick way, the length of the portion of strap used to perform the strapping of such bales in fibrous material.

It is a further aim of the invention to realize an automatic device for strapping bales in fibrous material, preferably in cotton, which allows to easily and quickly diversify the lengths of the various straps used during the same strapping cycle of a bale in fibrous material.

Further, aim of the invention is to realize an automatic device for strapping bales in fibrous material that allows the optimization and therefore the reduction of the strapping times for each pressing cycle.

Still, aim of the invention is to realize an automatic device for strapping bales in fibrous material with a simplified structure with respect to the strapping devices of the prior art.

Furthermore, aim of the invention is to realize an automatic device for strapping bales in fibrous material capable of being operatively associated with pre-existing presses of multiple types, including overground rotating box presses.

The aforesaid aims are achieved by an automatic device for strapping bales in fibrous material.

Further features of the automatic device for strapping bales in fibrous material of the invention are described herein.

Further, said aims are achieved by the system for making bales in fibrous material.

Furthermore, such aims are also achieved by the strapping method performed according to a preferred embodiment of the automatic strapping device of the invention.

BRIEF DESCRIPTION OF THE DRAWINGS

The aforesaid aims, together with the advantages that will be mentioned hereinafter, are indicated by the description of an embodiment of the invention, which is given by way of non-limiting example with reference to the attached drawings, where.

DETAILED DESCRIPTION OF THE PREFERRED EMBODIMENTS

The automatic device for strapping bales in fibrous material, preferably in cotton, of the invention is represented as a whole in FIGS. 1 to 8, where it is indicated with 1.

Such an automatic strapping device 1 is configured to tie a plurality of straps R around a bale B formed and pressed by a press 100 for bales in fibrous material.

Figure 1:
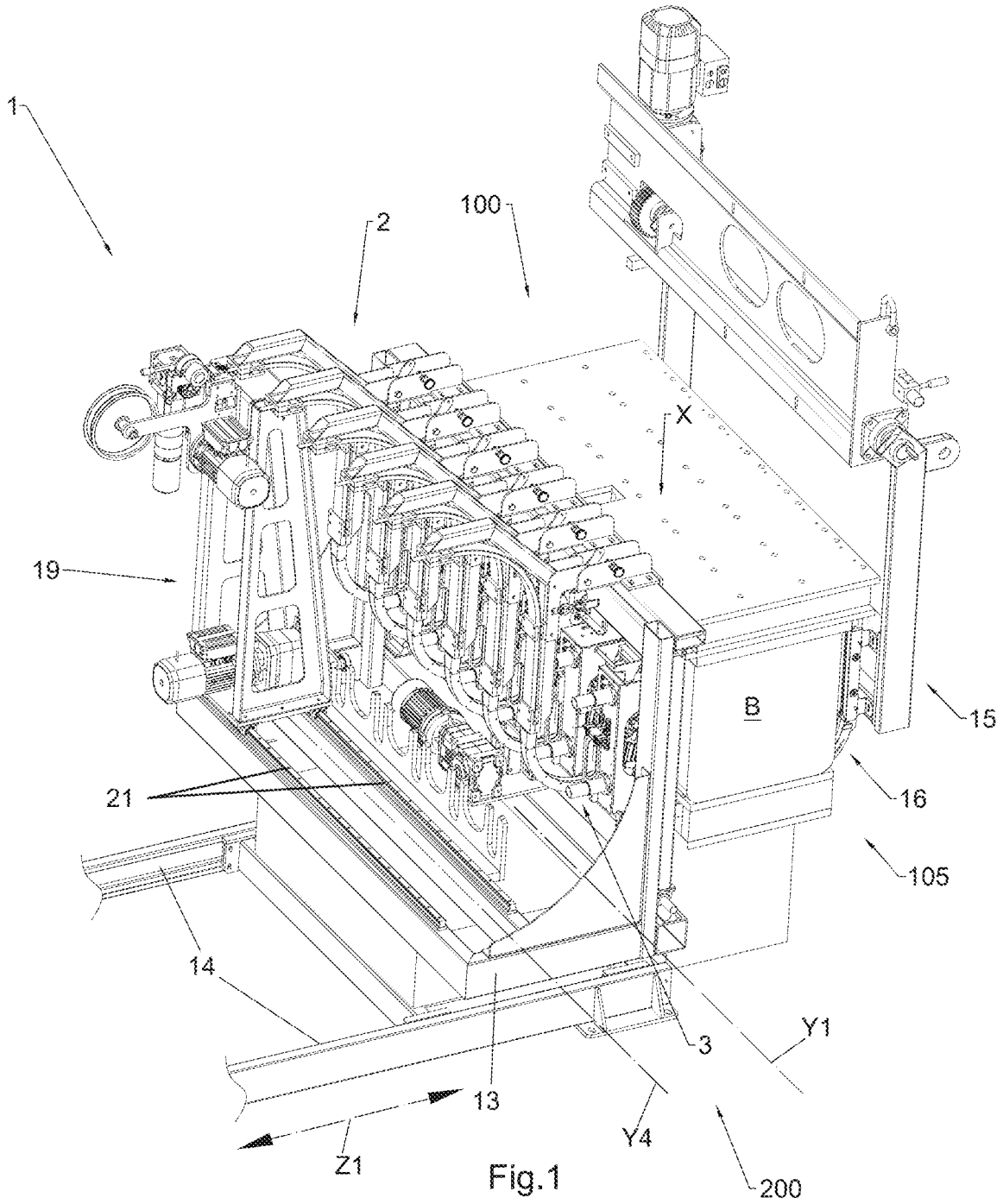
FIG. 1 depicts, in a first axonometric view, an automatic strapping device of the invention associated with a bale press, wherein the launching and welding assembly and the rear assembly of said device are arranged in their respective first positions.
Figure 2:
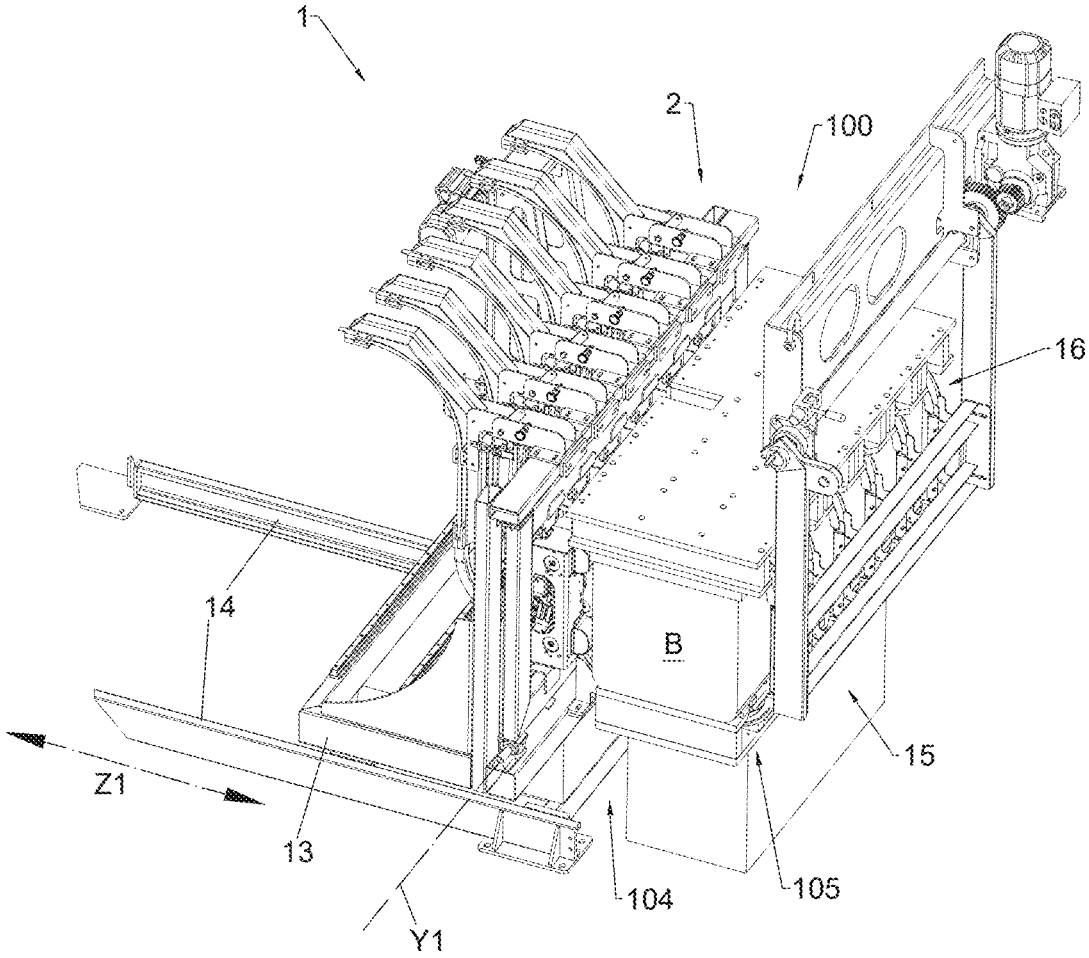
FIG. 2 depicts, according to a second axonometric view, the automatic strapping device of FIG. 1.
Figure 3:
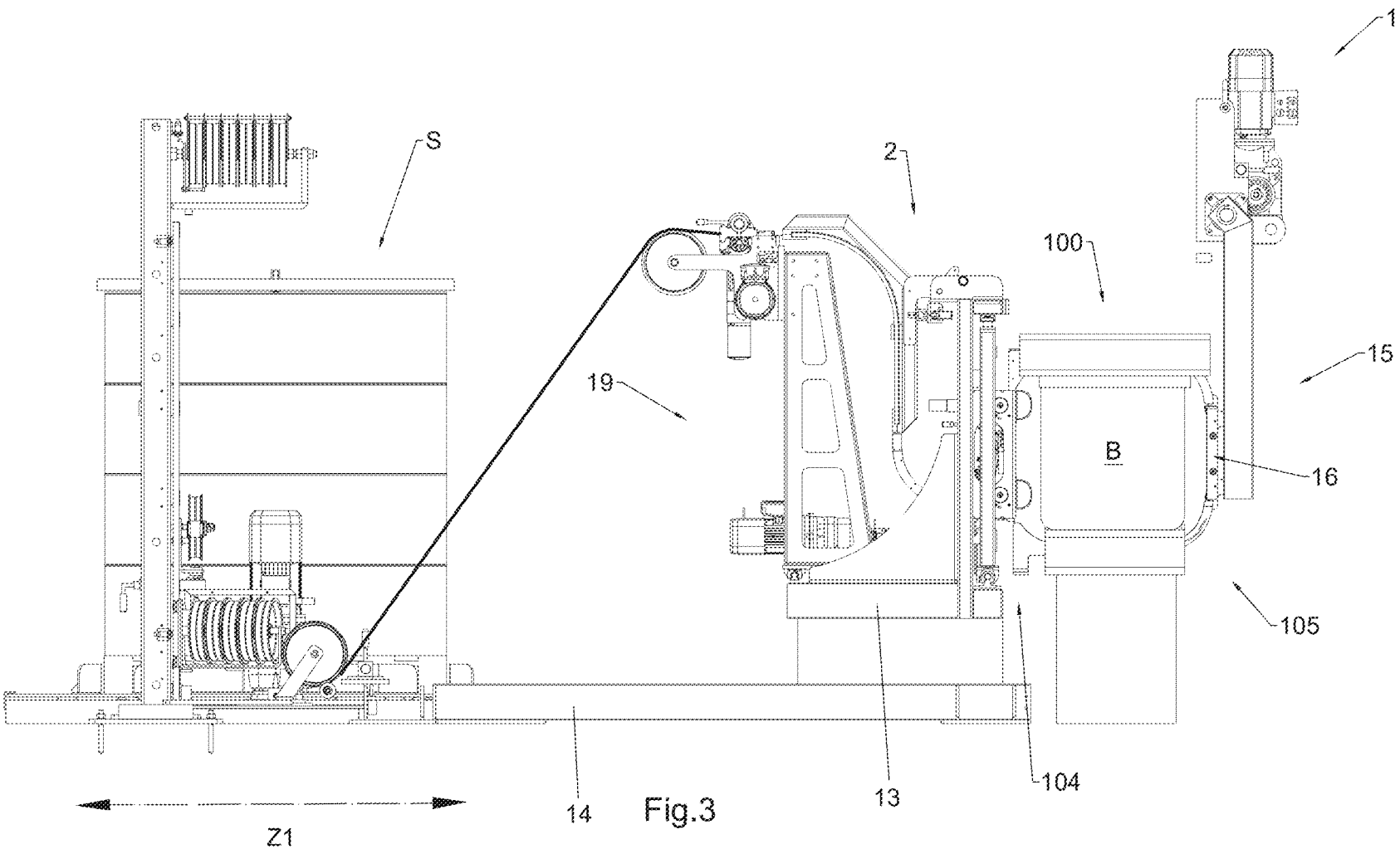
FIG. 3 depicts in side view the automatic strapping device of FIGS. 1 and 2.
Figure 4:
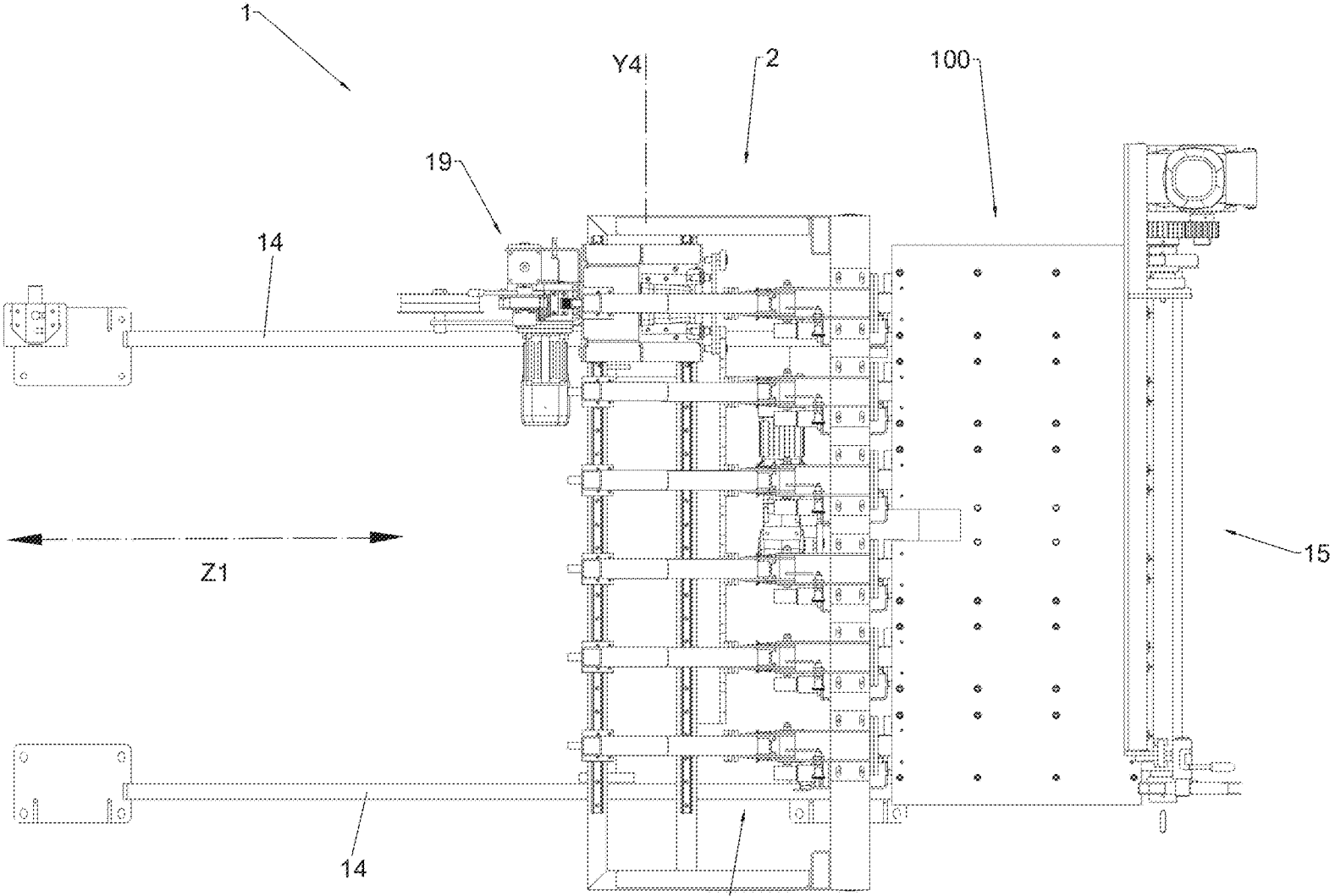
FIG. 4 depicts in a top view the automatic strapping device of FIGS. 1 and 2.
Figure 5:
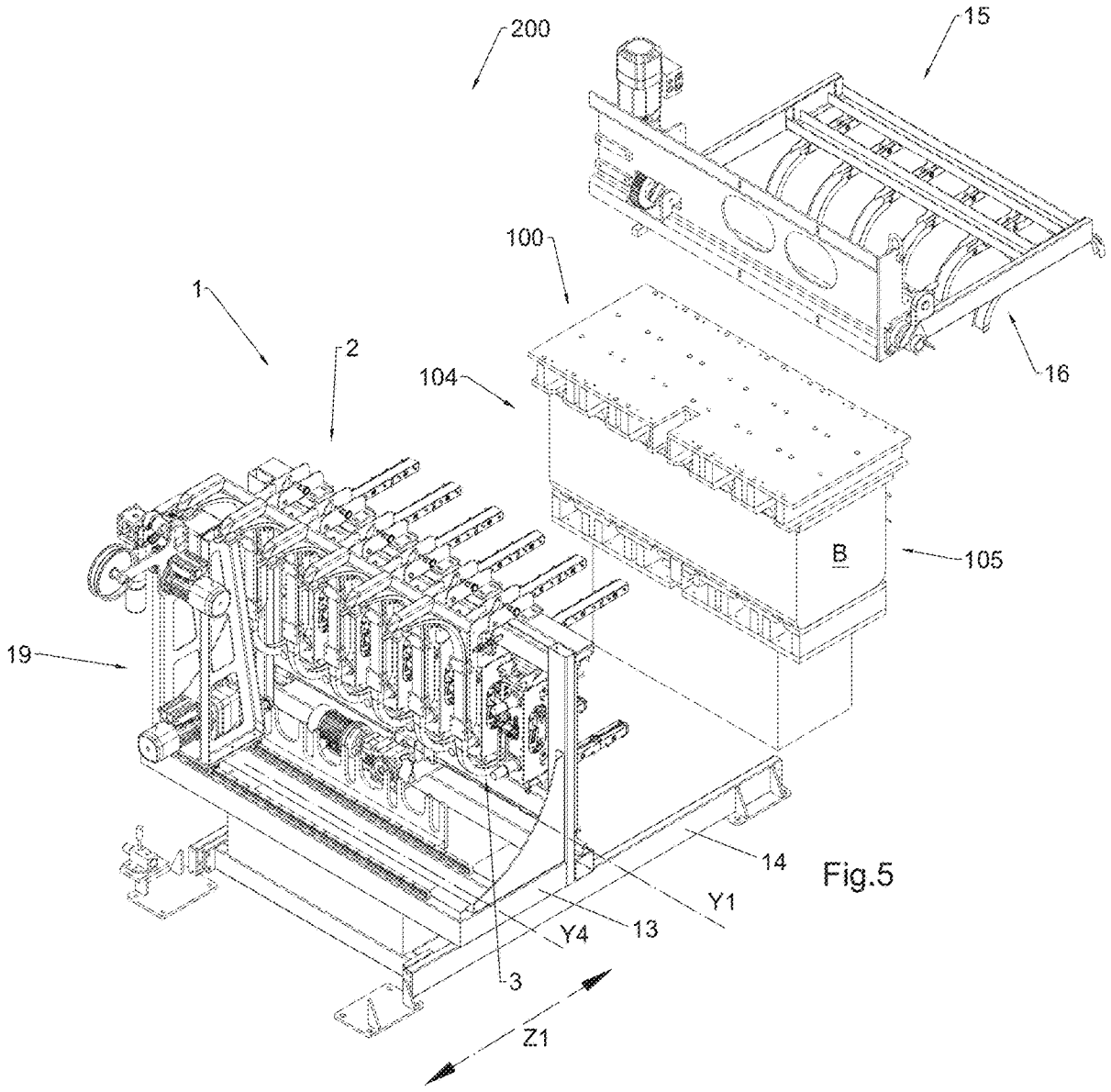
FIG. 5 depicts, in a first axonometric view, an automatic strapping device of the invention associated with a bale press, wherein the launching and welding assembly and the rear assembly of said device are arranged in their respective second positions.
Figure 6:
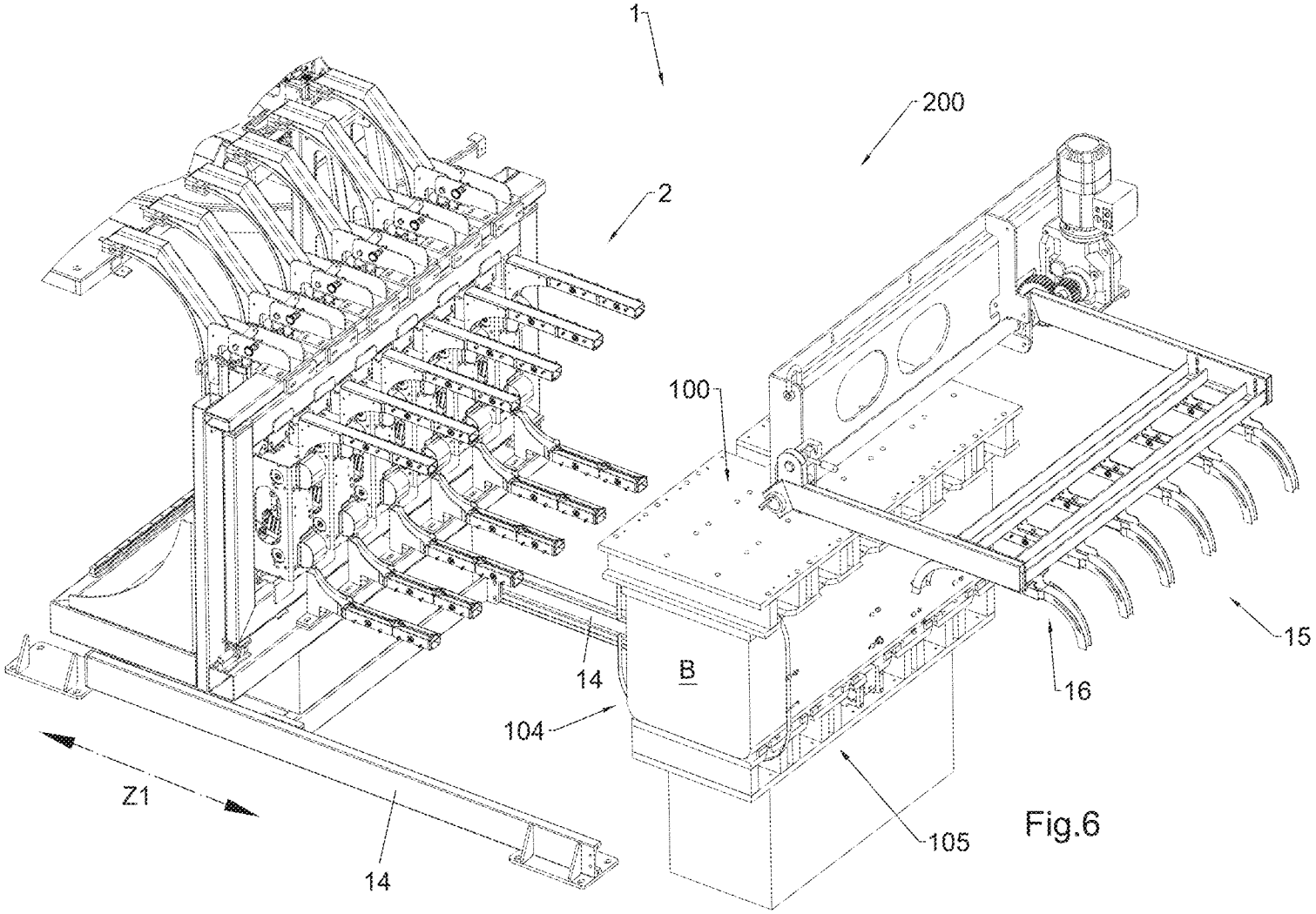
FIG. 6 depicts, according to a second axonometric view, the automatic strapping device of FIG. 5.
Figure 7:
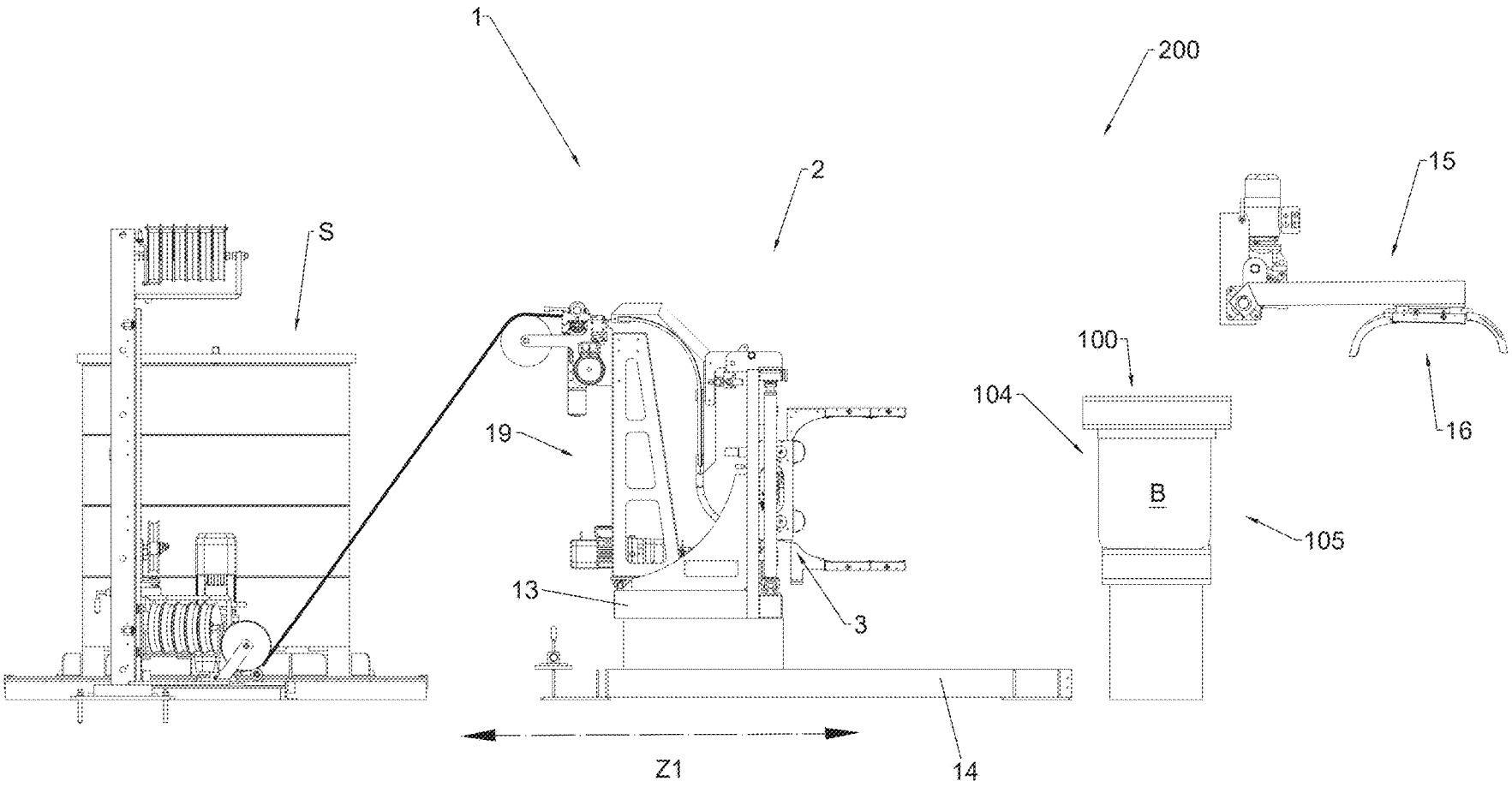
FIG. 7 depicts in side view the automatic strapping device of FIGS. 5 and 6.
Figure 8:
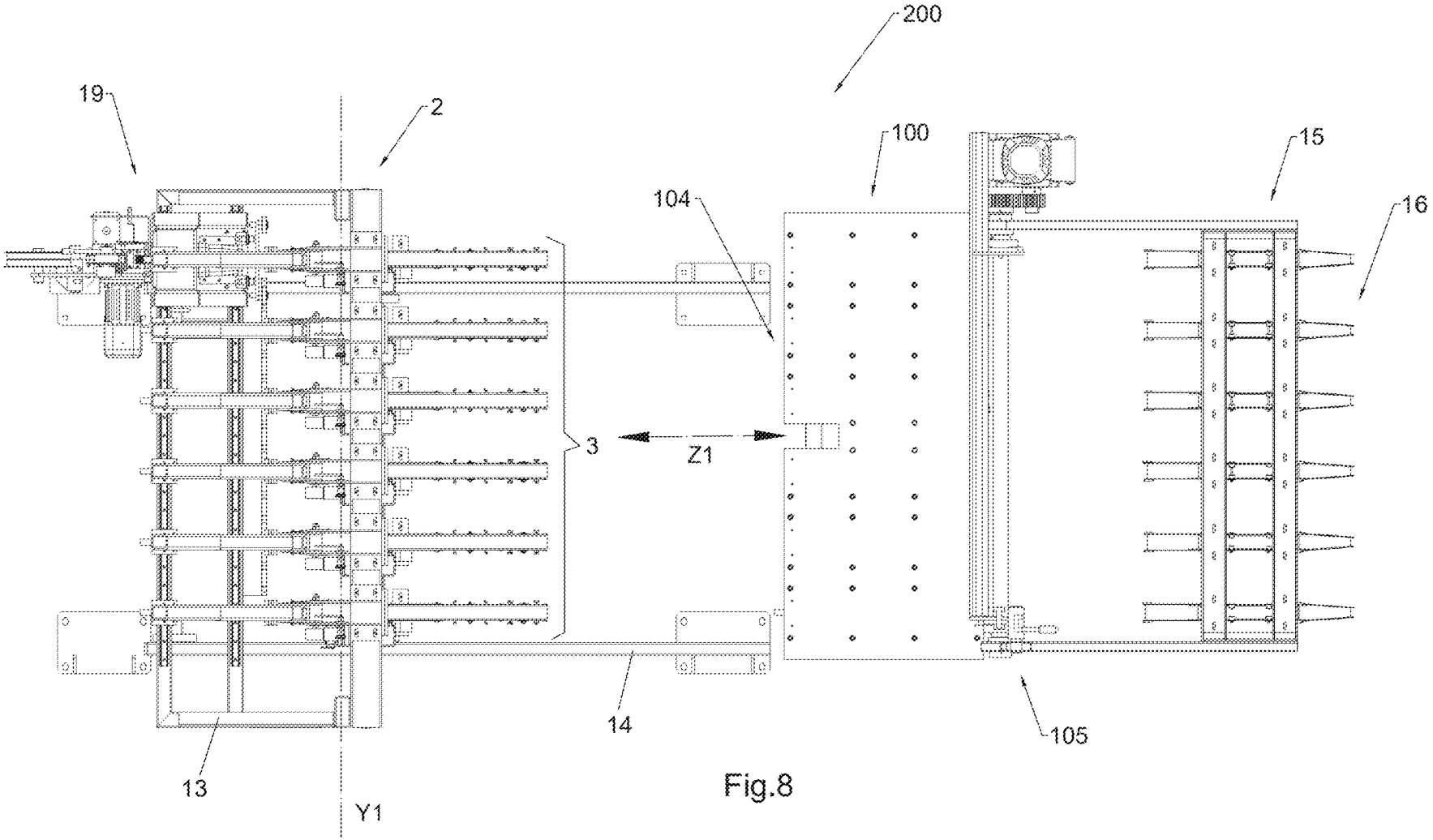
FIG. 8 depicts in a top view the automatic strapping device of FIGS. 5 and 6.
Figure 9:
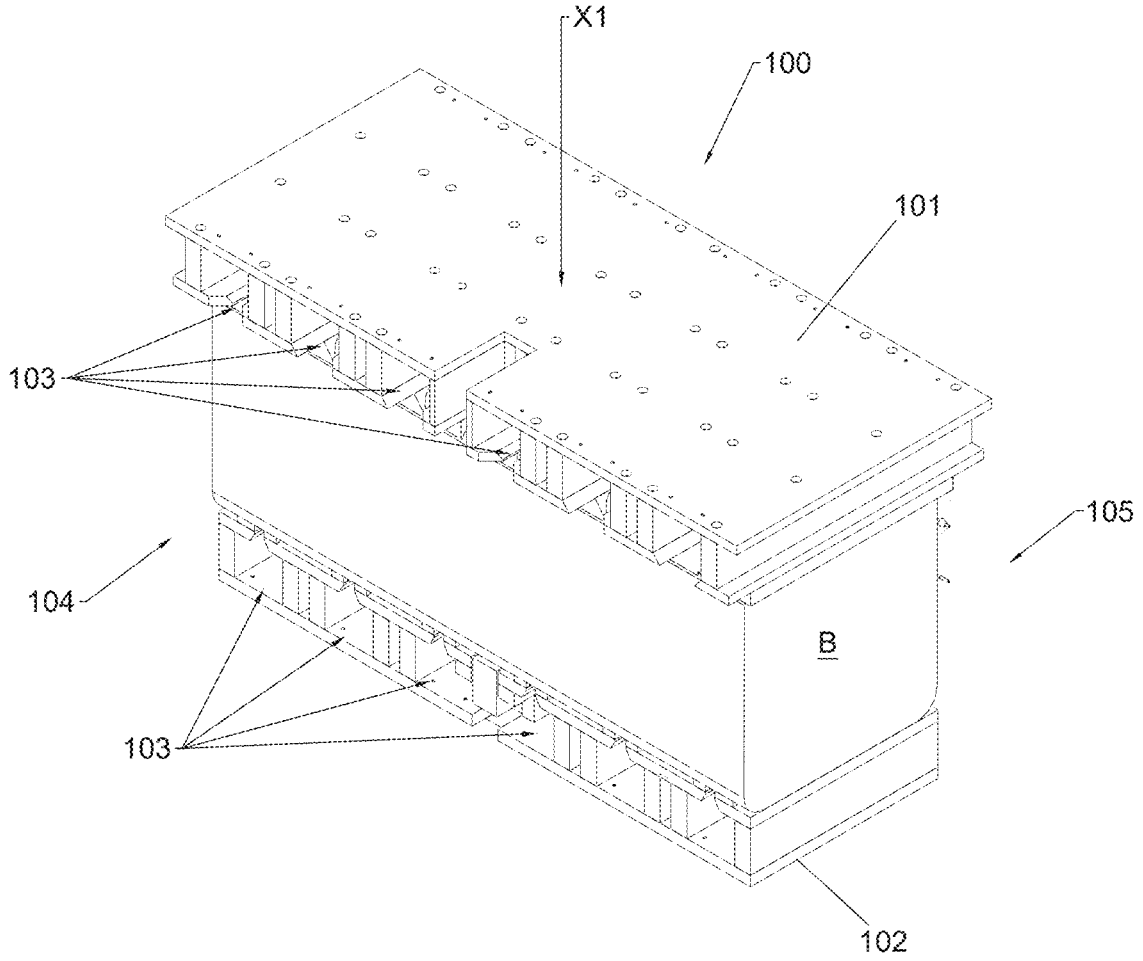
FIG. 9 depicts in an isolated view a bale press of the known type.

As regards the press 100 for bales, it is generally, as seen in FIG. 9, defined by a first pressing plate 101 and by a second pressing plate 102, which are arranged spaced apart and parallel to each other, and configured to be moved with respect to each other along a pressing direction indicated with X, in order to press a bale B of fibrous material.

In addition, each of said pressing plates 101 and 102 comprises a plurality of through grooves 103, made parallel to each other and orthogonal to said pressing direction X, through which a plurality of straps R are adapted to be inserted and wound around the pressed bale B.

In the present context, in order to define in a simple and clear way the positions of the various elements belonging to the automatic strapping device 1 of the invention with respect to the press 100, we will identify the two opposite sides of the press 100, parallel to the aforesaid pressing direction X and orthogonal to the aforesaid grooves 103, respectively as first side 104 and second side 105, as represented in FIG. 9.

As regards the straps R, they can be defined in metallic, plastic, thermoplastic material or any other material particularly suitable for strapping bales B in fibrous material, in particular in cotton.

Returning to the automatic strapping device 1, according to the invention, it comprises, as can be seen in FIGS. 1 to 8, a launching and welding assembly 2 of the plurality of straps R, adapted to be arranged at the first side 104 of the press 100. Said launching and welding assembly 2 in turn comprises a plurality of launching and welding heads 3, arranged side by side along an axis Y1 parallel to the first side 104 and orthogonal to the pressing direction X of the press 100.

In the preferred embodiment of the invention, as depicted in FIGS. 1 to 8, said plurality of launching and welding heads 3 comprises a number of six launching and welding heads 3.

It is not excluded, however, that the number of the aforesaid launching and welding heads 3 may be less than or greater than six.

Figure 10:
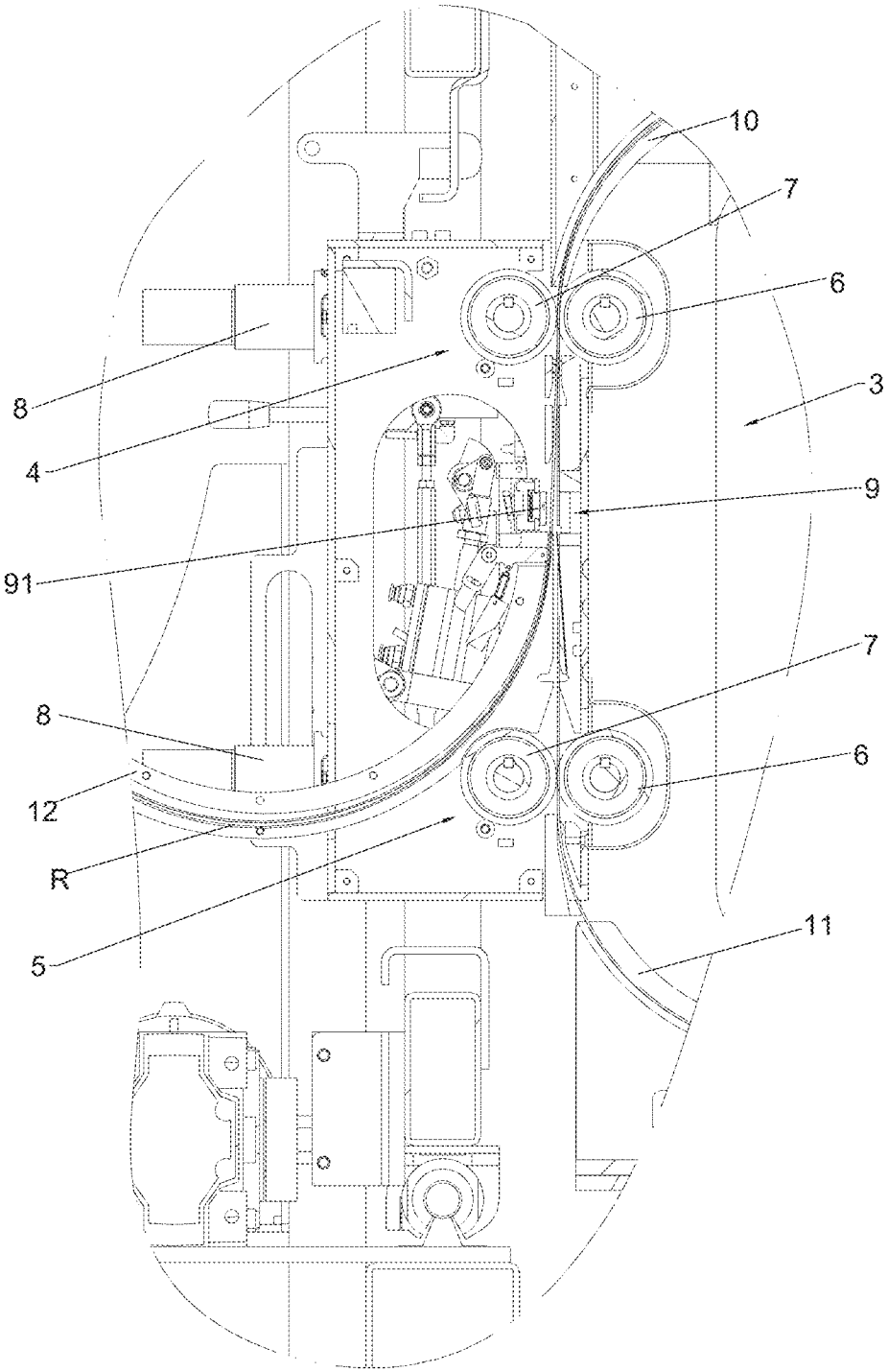
FIG. 10 depicts a launching and welding head belonging to the automatic strapping device of the invention.

As depicted in FIG. 10, each of said launching and welding heads 3 comprises a first launching and blocking unit 4, configured to receive a portion of strap R from a feeding assembly 19 and to launch said strap R around the pressed bale B.

Furthermore, each of said launching and welding heads 3 comprises a second launching and blocking unit 5, configured to receive and block a first end E1 of the portion of strap R following the launching by the first launching and blocking unit 4 and furthermore, as will be clarified below, to advance said first end E1 towards a welding unit 9.

Preferably, as seen in FIG. 10, the first launching and blocking unit 4 and the second launching and blocking unit 5 of each of the launching and welding heads 3 each comprise two opposed rollers 6 and 7, controlled by means of an electric actuator 8, in order to actuate the movement of the portion of strap R along the strapping trajectory and to block one of the two ends E1 and E2 of the same portion of strap R, as will be defined in detail below.

Further, each of the launching and welding heads 3 comprises the aforesaid welding unit 9, configured to join the ends E1 and E2 of the portion of strap R following their overlapping actuated by the joint action of the first launching and blocking unit 4 and of the second launching and blocking unit 5.

As can be seen in FIG. 10, said welding unit 9 is interposed between the first launching and blocking unit 4 and the second launching and blocking unit 5.

Still more specifically, the first launching and blocking unit 4, the second launching and blocking unit 5 and the welding unit 9 of each of the launching and welding heads 3 are aligned along the strapping trajectory of the portion of strap R around the pressed bale B.

Preferably but not necessarily, the welding unit 9 is a vibration-type welding unit 91.

Each launching and welding head 3 further comprises a first arched channel 10 and a second arched channel 11 which develop respectively from the first launching and blocking unit 4 and from the second launching and blocking unit 5, on the opposite side of the welding unit 9, in the direction of the press 100. The function of the aforesaid two arched channels 10 and 11 will be described specifically below.

Finally, preferably but not necessarily, each launching and welding head 3 comprises an inlet duct 12 placed upstream of the first launching and blocking unit 4, in order to allow the first launching and blocking unit 4 to receive a portion of strap R from the aforesaid feeding assembly 19.

According to the invention, as depicted in FIGS. 1 to 4, the launching and welding assembly 2 is configured to assume, with respect to the press 100, when arranged at the aforesaid first side 104, a first position according to which the first arched channel 10 and the second arched channel 11 of each of the launching and welding heads 3 are at least partially inserted in the aforesaid through grooves 103, defined along the first pressing plate 101 and along the second pressing plate 102 of the press 100.

According to the preferred embodiment of the invention, as depicted in FIGS. 5 to 8, said launching and welding assembly 2 is configured to assume, with respect to the press 100, also a second position according to which the first arched channel 10 and the second arched channel 11 of each of the launching and welding heads 3 are completely released from the through grooves 103 of the aforesaid press 100.

In other words, the launching and welding assembly 2 is configured to be moved with respect to the press 100 from the first position to the second position, and vice versa.

Such movement from the first position to the second position and vice versa, as will be more specifically indicated during the description of the operation of the automatic strapping device 1 of the invention, advantageously allows to perform some of the operations of the strapping method at the same time as the execution of the operation of pressing the bale B in fibrous material, thus optimizing the cycle times of the entire strapping and pressing process.

Furthermore, since said launching and welding assembly 2 and the relative feeding assembly 19 are totally released from the press 100, apart from when it is obviously necessary to perform the actual strapping operation, it is possible to install said automatic strapping device 1 of the invention at any type of presses 100 already present in the state of the art.

According to the preferred embodiment of the invention, the aforesaid movement is made along a movement direction Z1, orthogonal to the aforesaid first side 104 of the press 100 and to the pressing direction X, so as to be able to translate the launching and welding assembly 2 from its first position to its second position, and vice versa.

Even more in detail, as can be seen in FIGS. 1 to 8, the launching and welding assembly 2 comprises a supporting frame 13 on which the plurality of the launching and welding heads 3 are fixedly mounted. Said launching and welding assembly 2 further comprises a pair of rails 14 defined parallel along the aforesaid movement direction Z1 on which the supporting frame 13 is configured to be moved from the aforesaid first position to the second position, and vice versa.

It is not excluded, however, that according to alternative embodiments of the automatic strapping device 1 of the invention such movement from the first position to the second position and vice versa can be performed according to a different trajectory with respect to the movement direction Z1, or, likewise, by means of a different mechanical solution, with respect to the aforesaid two rails 14.

Returning to the automatic strapping device 1, it further comprises a rear assembly 15, adapted to be arranged at the second side 105 of the press 100, opposite the aforesaid first side 104.

This rear assembly 15 is provided with a plurality of third arched channels 16 equal to the number of the plurality of launching and welding heads 3.

Figure 12:
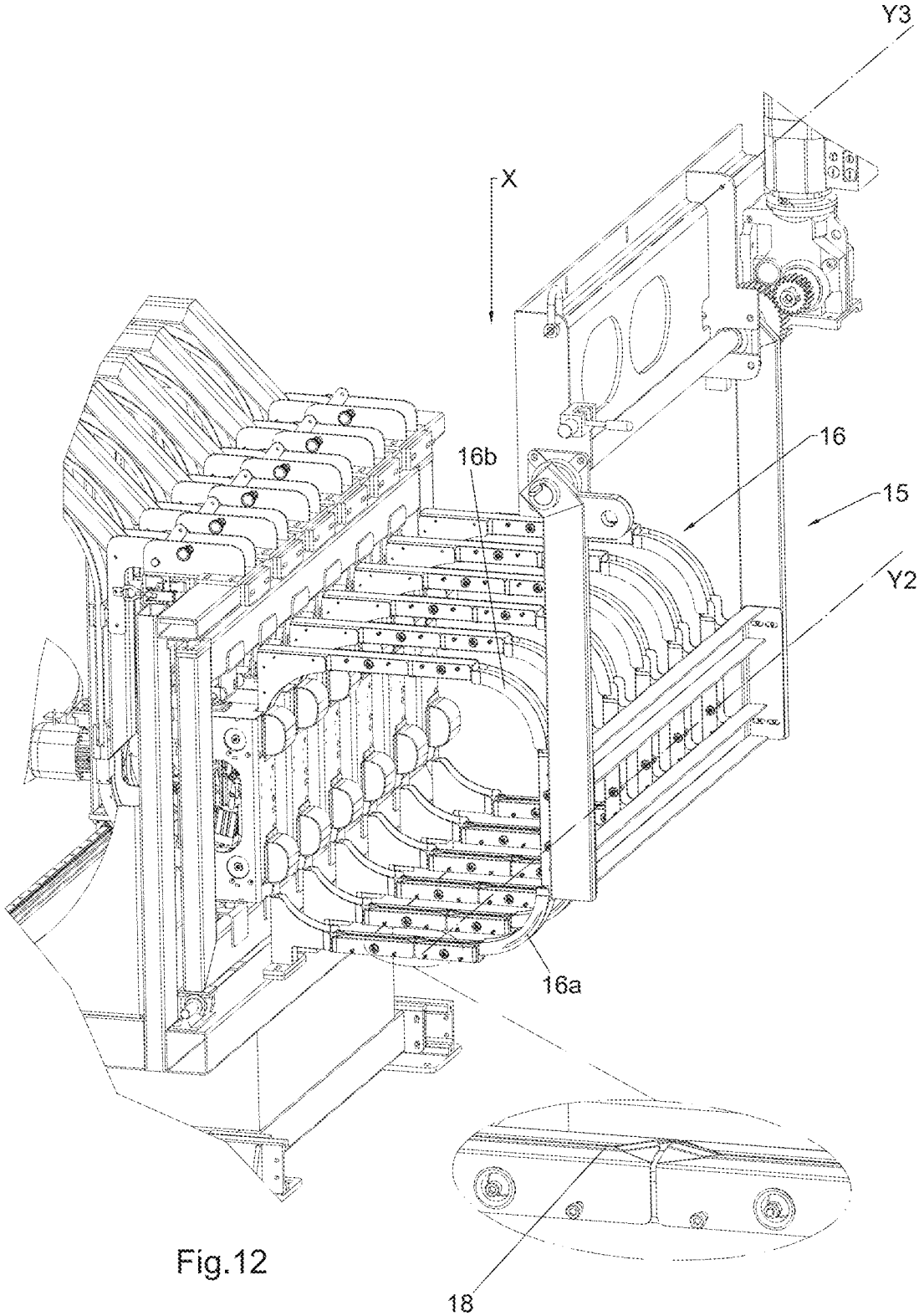
FIG. 12 depicts a detail of the rear assembly belonging to the automatic strapping device of the invention.

In particular, as seen in FIG. 12, the third arched channels 16 are arranged side by side one another along an axis Y2, parallel to the second side 105 and orthogonal to the pressing direction X of the press 100, and each of the aforesaid third arched channels 16 is shaped such that both ends 16*a* and 16*b* thereof face the aforesaid press 100.

More specifically, as can be seen in FIGS. 1 to 4, the rear assembly 15 is configured to assume, with respect to the press 100, when arranged at the second side 105, a first position according to which each of the third arched channels 16 has both its ends 16*a* and 16*b* at least partially inserted in the through grooves 103, made on each of the two pressing plates 101 and 102.

Figure 13:
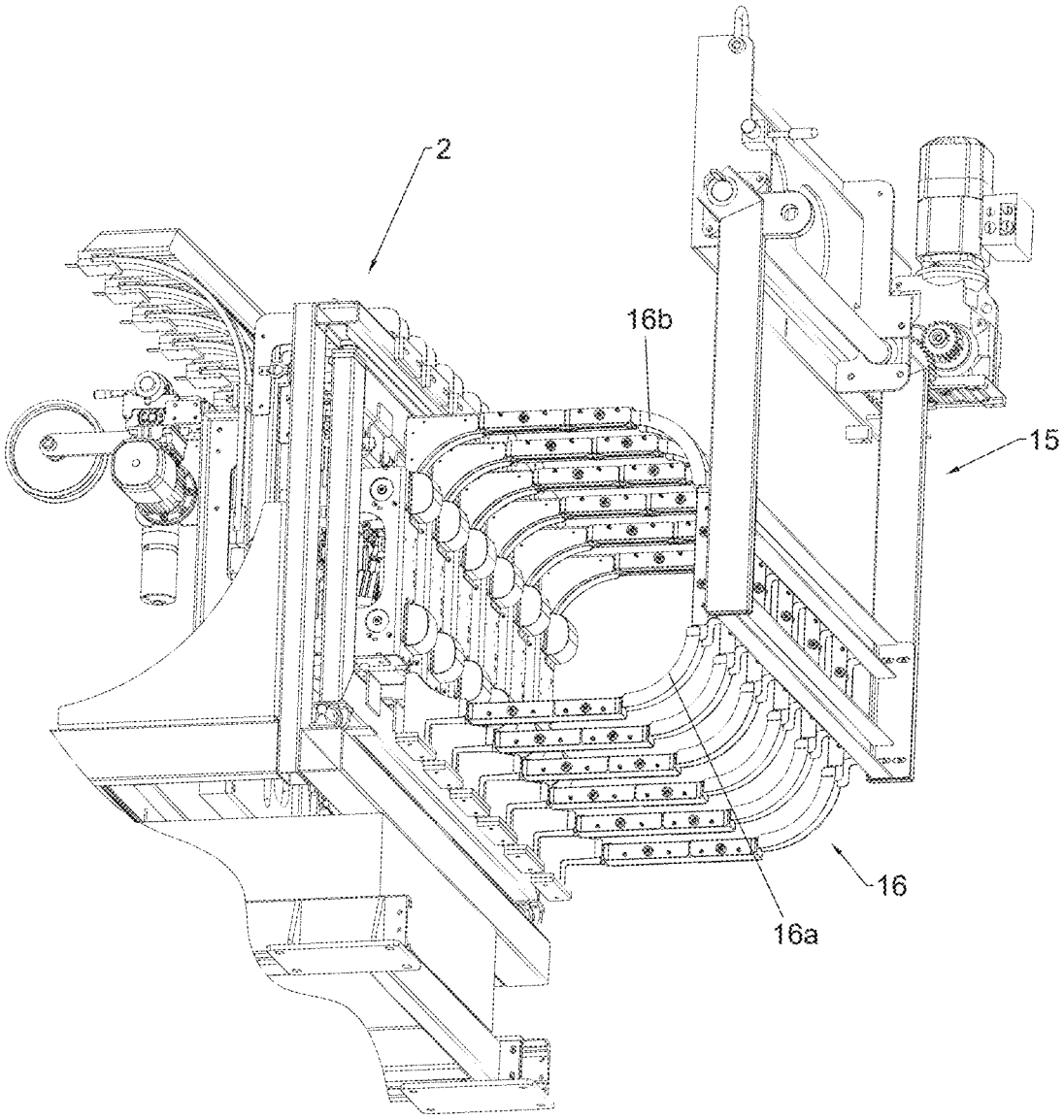
FIG. 13 depicts the strapping path defined by the coupling between a launching and welding head of the launching and welding assembly and a third arched duct of the rear assembly.

At this point, it is important to highlight that, according to the invention, when the rear assembly 15 and the launching and welding assembly 2 are arranged in the respective first positions with respect to the press 100, each of the launching and welding heads 3, in particular the first arched channel 10 and the second arched channel 11 of each of the launching and welding heads 3, are coupled to one of the third arched channels 16, so as to define a strapping path 17 around the pressed bale B, as seen in FIG. 13.

Even more in detail, said strapping path 17 defined by the coupling of the aforesaid first arched channel 10, second arched channel 11 and third arched channel 16, has a perimeter development greater than the perimeter development of the pressed bale B. The functionality and the technical advantages obtained by the latter feature will be explained below. In particular, in order to be able to obtain the aforesaid advantages defined below, it is envisaged that the first arched channels 10, the second arched channels 11 and the third arched channels 16 all have a slot 18 at their inner side adapted to be facing the pressed bale B, so as to allow the strap R wound in them to exit towards said pressed bale B, when the ends E1 and E2 of the same strap are approached and overlapped with each other.

According to the preferred embodiment of the invention, as visible in FIGS. 5 to 8, the rear assembly is also configured to assume, with respect to the press 100, when arranged at the second side 105, a second position according to which each of the third arched channels 16 is completely released from the press 100.

Thus, as in the case of the launching and welding assembly 2, the rear assembly 15 is also configured to be moved with respect to the press 100 from its first position to the aforesaid second position, and vice versa.

Preferably, as seen in FIG. 12, the rear assembly 15 is rotatably coupled to the press 100 according to a rotation axis Y3, parallel to the second side 105 and orthogonal to the pressing direction X, so as to be able to pass through a rotary movement from said first position to the second position, and vice versa.

Returning to the automatic strapping device 1 of the invention, it finally comprises, as mentioned above, a feeding assembly 19 of the strap R, configured to feed each of the launching and welding heads 3 with a portion of strap R of predefined length.

Figure 11:
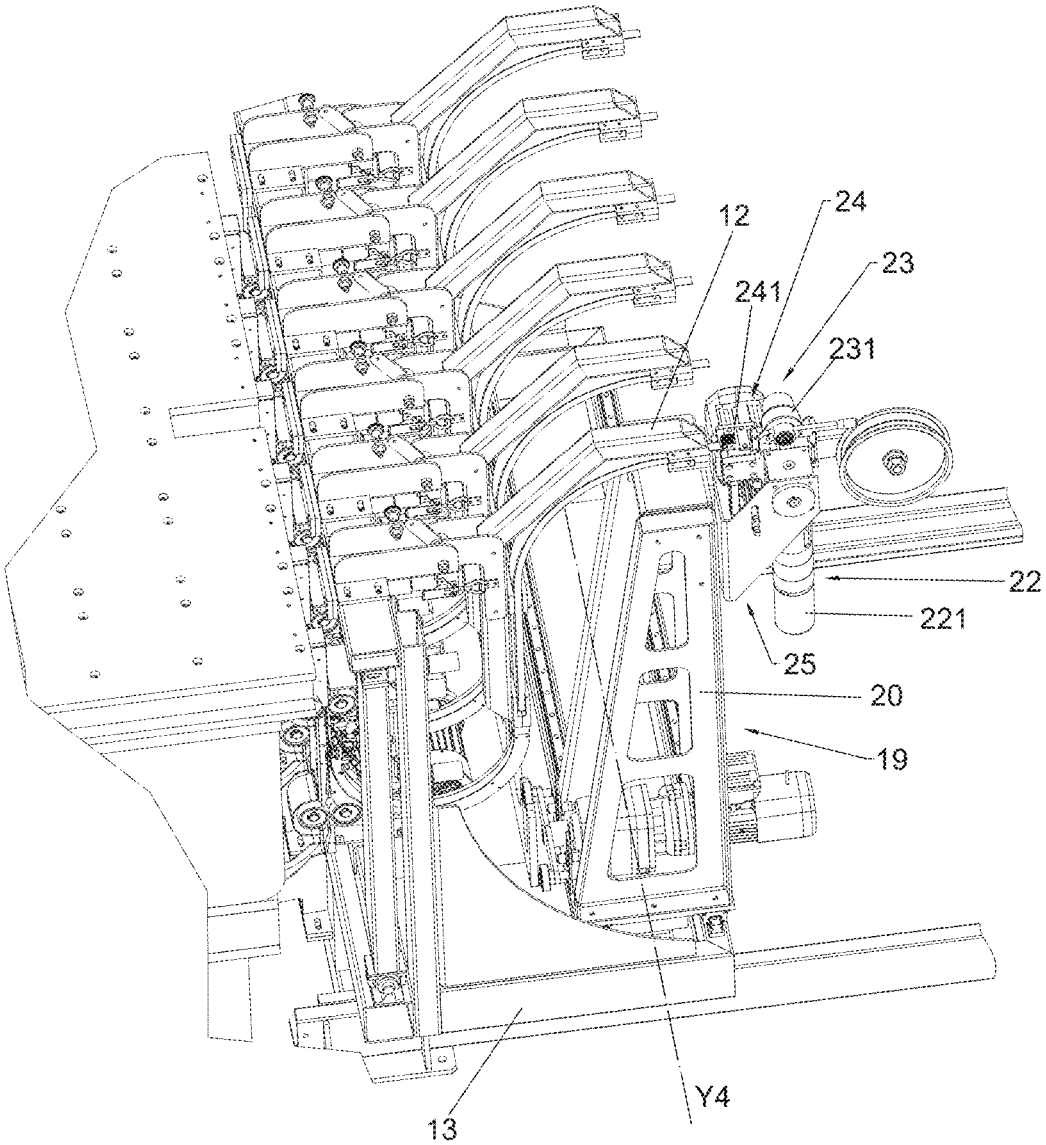
FIG. 11 depicts a detail of the feeding assembly belonging to the automatic strapping device of the invention.

According to the invention, preferably, said feeding assembly 19, as seen in FIG. 11, is configured to be moved with respect to the launching and welding assembly 2 along an axis Y4, parallel to the first side 104 of the press 100 and orthogonal to the pressing direction X, so that the same feeding assembly 19 can be selectively arranged at each of the inlet ducts 12 of each of the launching and welding heads 3. This advantageously allows a single feeding assembly 19 to be used to supply all the launching and welding heads 3 with a specific portion of strap R. Consequently, such uniqueness of the feeding assembly 19 allows to simplify the structure of the automatic strapping device 1 of the invention with respect to the device of the prior art.

As will be described below, since the feeding assembly 19 of the invention is configured to supply the launching and welding heads 3 with the aforesaid portions of straps R during the pressing operation by the press 100, even if said supply takes place selectively for each of the aforesaid launching and welding heads 3, this does not entail a slowing down of the overall process for making a bale B in fibrous material, since said operation is carried out precisely at the same time as the necessary pressing phase. Furthermore, still advantageously, as will be specified below, the fact that the feeding assembly 19 selectively supplies a portion of strap for each of the launching and welding heads 3 allows to supply each launching and welding head 3 with a portion of strap R of different length from the portion of straps R supplied to the other launching and welding heads 3.

According to the preferred embodiment of the invention, in particular, in order to be able to actuate such movement of the feeding assembly 19 with respect to the launching and welding assembly 2, the same feeding assembly 19 is mounted on a truss 20, slidably coupled to the aforesaid supporting frame 13, by means of a pair of rails 21, fixedly arranged on the supporting frame 13 along said axis Y4.

It is not excluded, however, that such movement of the feeding assembly 19 with respect to the launching and welding assembly 3 can be actuated by means of different mechanical configurations with respect to the one just described.

A further important aspect of the feeding assembly 19 concerns the fact that it is provided with an electric actuator 22, in particular a brushless motor 221, configured to move the strap R from a feeding reel S on each of the inlet ducts 12, and with measuring means 23, in particular an encoder 231, configured to measure the length of the portion of strap R moved by the electric actuator 22 in said inlet duct 12. In this way, with the same feeding assembly 19, advantageously, it is possible to effectively control, for each launching and welding head 3, independently of the other launching and welding heads 3, the length of the portion of strap R supplied at its inlet duct 12.

Obviously, the feeding assembly 19 also comprises cutting means 24, in particular a shear 241, configured to cut from the feeding reel S a portion of strap R of pre-established length, once the latter is inserted in each of said inlet ducts 12.

Finally, said feeding assembly 19 of the invention advantageously comprises electronic control means 25 configured to control the electric actuator 22 and the cutting means 24 and to receive as input the data acquired by the measuring means 23.

As will be described in detail below, such a configuration of the feeding assembly 19 allows to adjust in a simple and quick manner, by appropriately programming the aforesaid electronic control means 25, the length of the portion of strap R to be supplied to each of the launching and welding heads 3, for each strapping cycle and also for each single launching and welding head 3, independently of the remaining launching and welding heads 3 belonging to the same automatic strapping device 1 of the invention.

This is particularly advantageous as it is known that very often there is a need to wind, along the longitudinal extension of a bale B in fibrous material, a plurality of straps of different length and therefore differently tensioned, so as to compensate for the different behaviours of the same bale B along its longitudinal extension.

In addition, advantageously, this possibility of adjustment allows, for the same launching and welding head 3, to vary the length of the strap R between the various cycles, so as to adapt to the different behaviours of the pressed bales B due to changes in the intrinsic conditions of the material and/or to changes in the environmental conditions, or so as to adapt the size of the same bales B, according to the needs and the spaces available for their transport and their storage.

The system 200 for making bales B in fibrous material, in particular in cotton, comprising a press 100 for bales which is associated with an aforesaid automatic strapping device 1 of the invention is also part of the invention.

Furthermore, the automatic method for strapping bales B in fibrous material by means of said automatic strapping device 1 of the invention is also part of the invention.

Figure 14A:
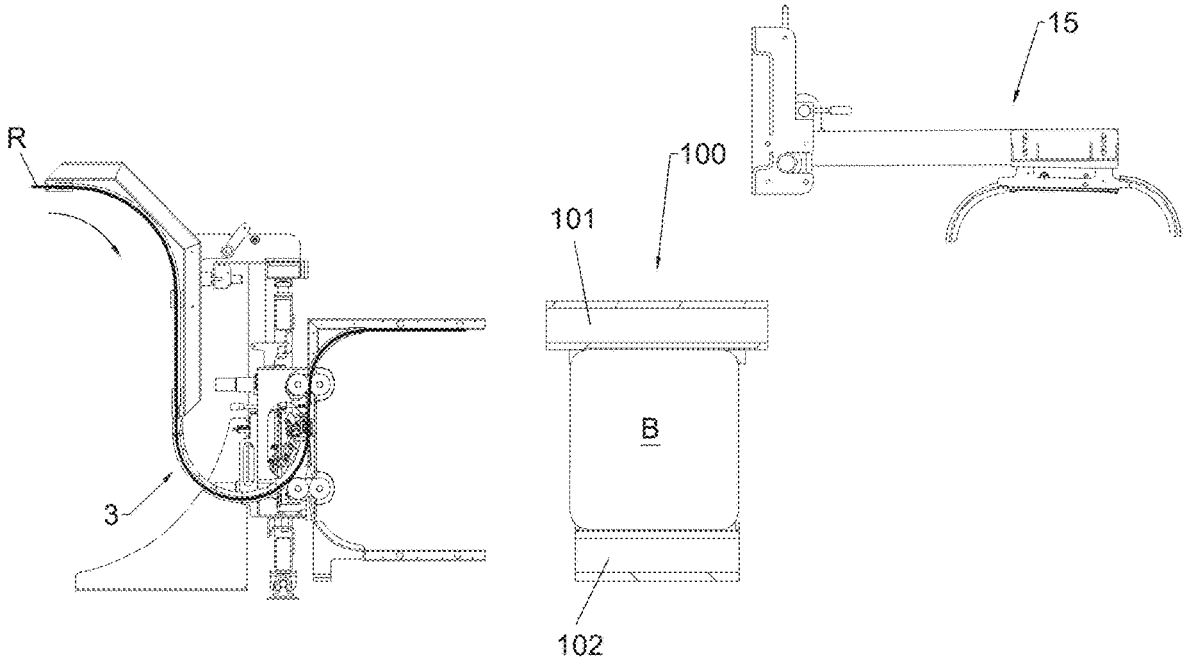
FIGS. 14*a*) to 14*f*) schematically depict the operations of the strapping method of the invention.

In particular, operationally, in order to be able to perform the pressing operation of a bale B by means of the aforesaid press 100 and, simultaneously and subsequently, to perform the strapping operations, it is necessary that the launching and welding assembly 2 and the rear assembly 15 are both arranged in their respective second positions, as seen in FIG. 14*a*), so as to allow the movement of the two pressing plates 101 and 102 of the same press 100.

During this pressing operation, the method of the invention provides for selectively moving the feeding assembly 19 at each of the launching and welding heads 3, so as to arrange on each of them a portion of strap R of predefined length.

In particular, as seen above, the fact that the feeding assembly 19 is provided with an electric actuator 22 associated with an encoder 231, both interfaced with electronic control means 25, allows to place on each launching and welding head 3, independently of the remaining launching and welding heads 3, a portion of strap R of specific length and possibly different from the lengths of the other portion of straps R.

Furthermore, advantageously, the fact that the feeding of the aforesaid portion of straps R to the various launching and welding heads 3 of the launching and welding assembly 2 takes place during the pressing operation allows to optimize and reduce the cycle times of the entire pressing and strapping process of a bale B.

Clearly, once the specific portion of strap R is supplied for each launching and welding head 3, the same portion of strap R is cut and then separated from the feeding reel S by the aforesaid cutting means 24.

Each launching and welding head 3, when receiving from the feeding assembly 19 the relative portion of strap R, is configured to block the first end E1 of said portion of strap R through the first launching and blocking unit 4.

Figure 14B:
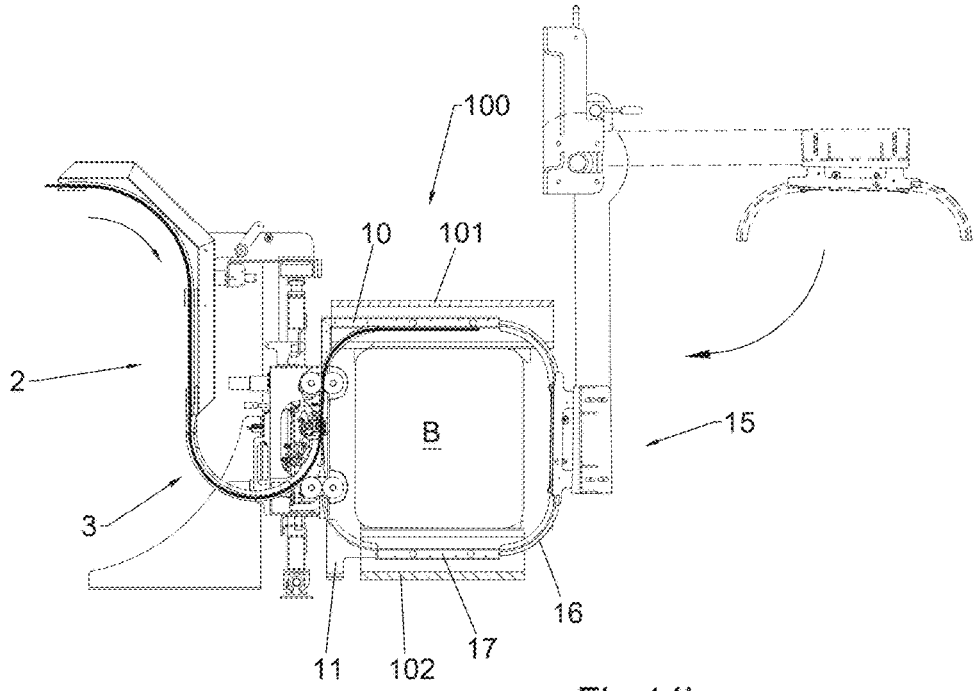

The method of the invention, once the various portion of straps R are arranged on all the launching and welding heads 3 and at the end of the pressing operation, by keeping the bale B pressed between the two pressing plates 101 and 102, envisages moving the launching and welding assembly 2 and the rear assembly 15 in the respective first positions, as can be seen in FIG. 14*b*), so as to define the aforesaid strapping paths 17 around the pressed bale B.

Figure 14C:
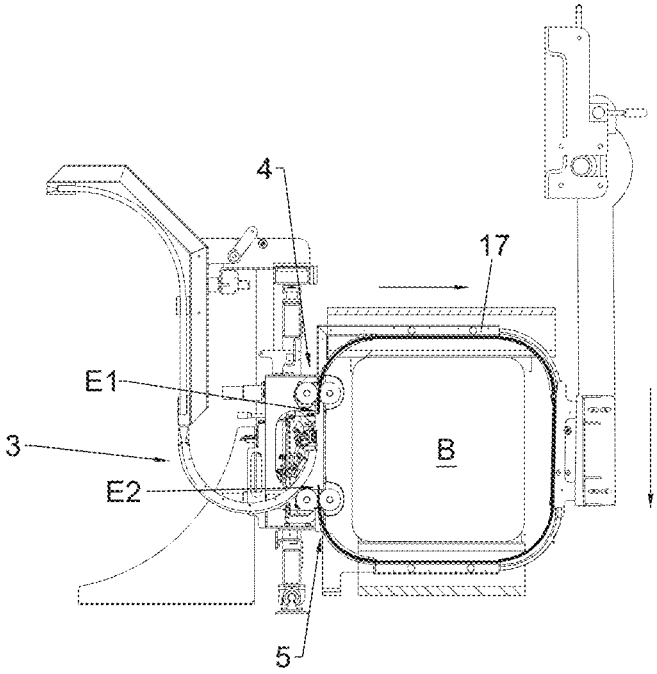

Subsequently, as shown in FIG. 14*c*), the method provides for launching, by means of the aforesaid first launching and blocking unit 4, each of the portion of straps R within its strapping path 17, around the pressed bale B, in such a way as to lead the aforesaid first end E1 of each portion of strap R at the second launching and blocking unit 5, which will block the same first end E1. According to the preferred embodiment of the invention, each of the first launching and blocking units 4 provides, in turn, to block the same portion of strap R in such a way that its second end E2 is arranged at the welding unit 9.

It is not excluded, however, that according to an alternative version of the method of the invention the first launching and blocking units 4 are configured to block the strap R in such a way that the relative second ends E2 are blocked precisely at said first launching and blocking units 4.

At this point, according to the preferred embodiment of the invention, in order to complete closing the ring of the portion of strap R contained in the aforesaid strapping path 17, the method provides that the second launching and blocking unit 5 completes closing the ring of the portion of strap R by bringing the first end E1 at the welding assembly 9 and in overlap with the second end E2.

In this way, all the operations for closing the ring of the aforesaid straps R and overlapping the two ends E1 and E2 perfectly in the welding position 9 take place without any rotation inversion of the launching and blocking assemblies and without any change in the movement direction of the portion of straps R.

Alternatively, in case both ends E1 and E2 are blocked at one of the two launching and blocking units 4 and 5, the method of the invention envisages moving according to opposite directions the two ends E1 and E2 of each portion of strap R so as to induce their overlapping at the welding unit 9. Such movement is implemented by actuating the first launching and blocking unit 4 and the second launching and blocking unit 5 of each launching and welding head 3.

In both cases, by means of this operation, the portion of strap R evidently tends to exit from the slots 18 of the aforesaid first arched channel 10, second arched channel 11 and third arched channel 16, thus allowing to reduce the perimeter extension of the ring defined by each portion of strap R and precisely allowing to induce the overlapping of the aforesaid two ends E1 and E2 of the same portion of strap R.

Figure 14D:
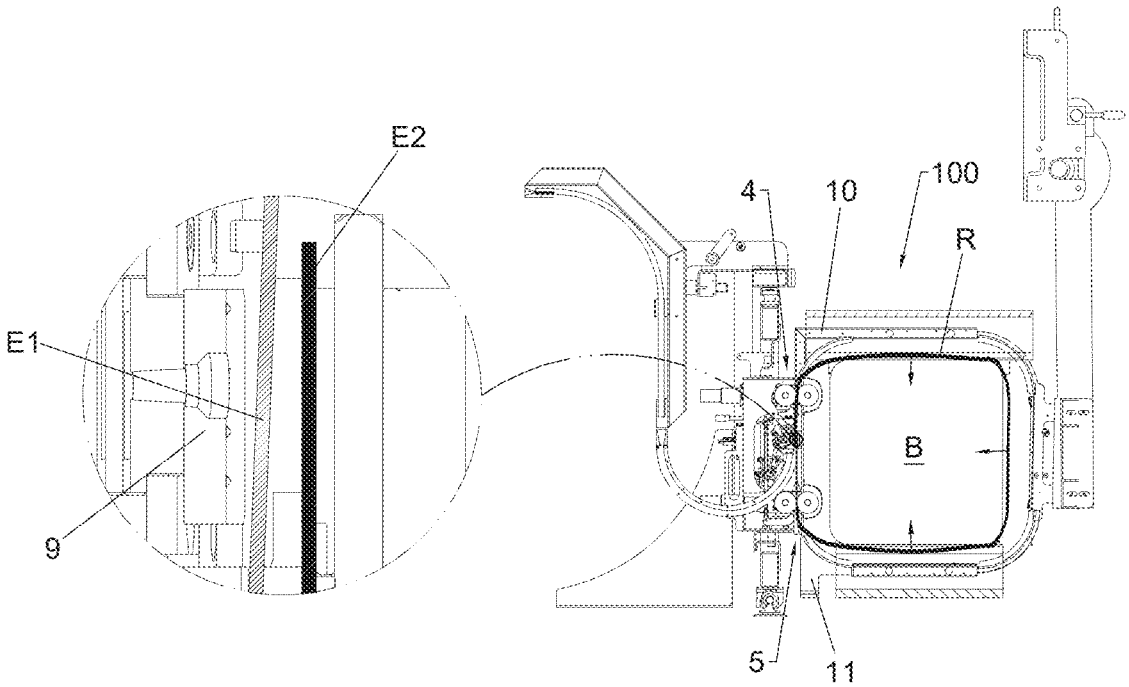
Figure 14E:
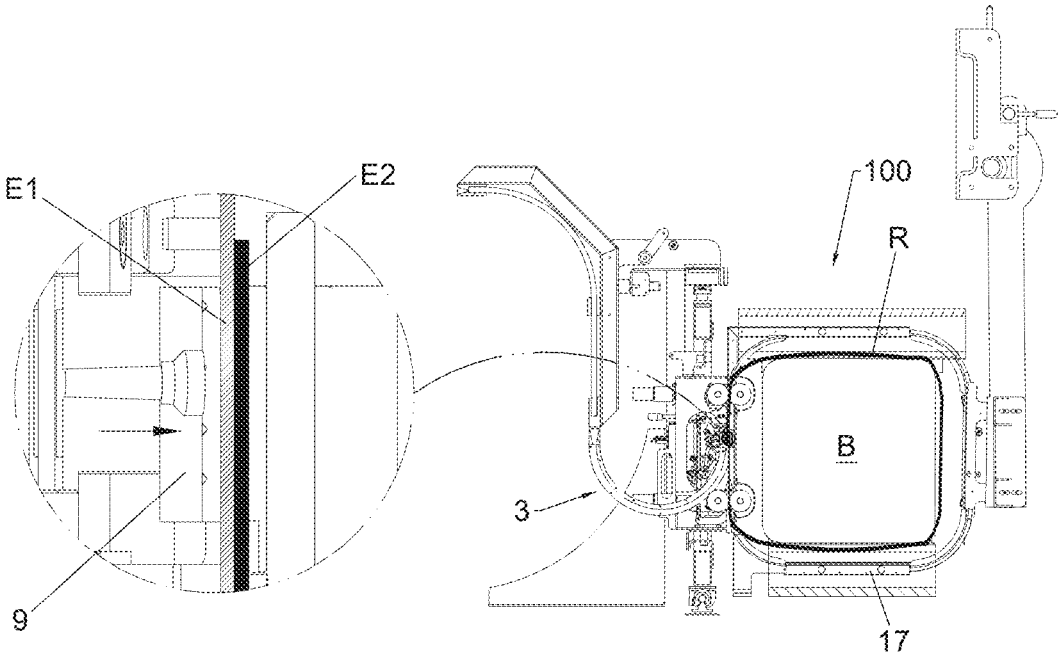
Figure 14F:
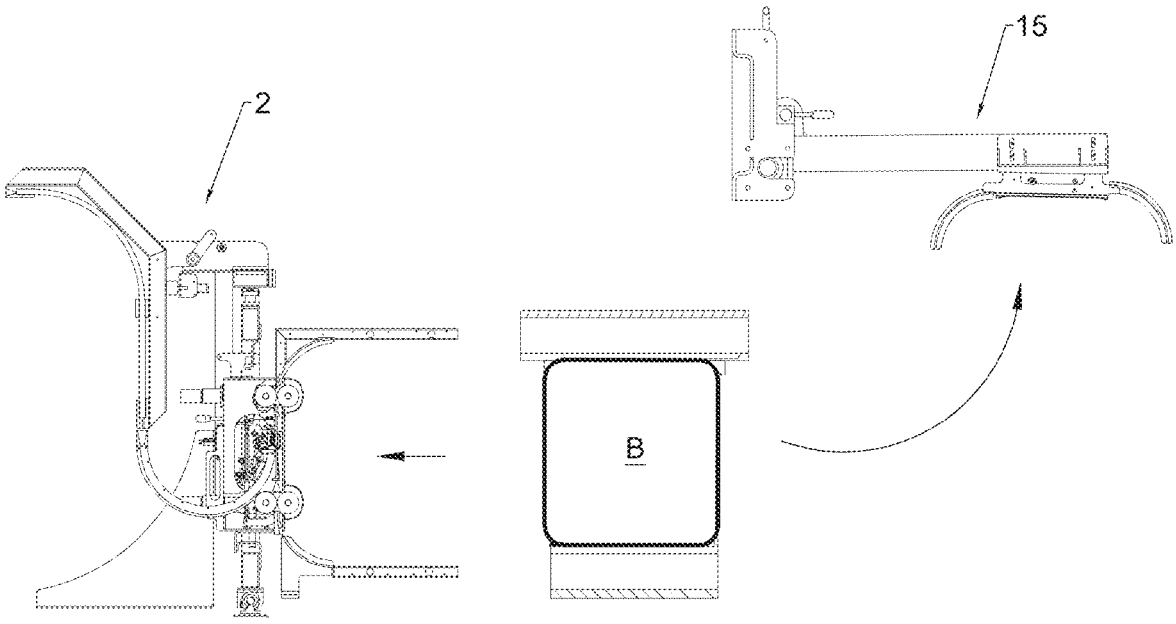

Furthermore, as depicted in FIG. 14*d*), the method provides for actuating the welds of the two overlapped ends E1 and E2 of each of the portion of straps R by means of the welding unit 9 of each launching and welding head 3. Finally, as can be seen schematically in FIG. 14*f*), the method of the invention envisages moving both the launching and welding assembly 2 and the rear assembly 15 at their respective second positions, so as to release the press 100 again from the automatic strapping device 1 of the invention.

According to what has been described, it is understood that the automatic strapping device 1 of the invention, the system 100 for making bales in fibrous material, in particular in cotton, of the invention and the method of the invention achieve all the intended purposes.

In particular, the aim of realizing an automatic device for strapping bales in fibrous material, preferably in cotton, which allows to modify, between one strapping process and the next, in a simple and quick way, the length of the strap used to perform strapping of such bales in fibrous material is achieved.

A further achieved aim is to realize an automatic device for strapping bales in fibrous material, preferably in cotton, which allows to easily and quickly diversify the lengths of the various straps used during the same strapping cycle of a bale in fibrous material.

Further, an achieved aim is the realization of an automatic device for strapping bales in fibrous material that allows the optimization and therefore the reduction of the strapping times for each strapping cycle.

Still, an achieved aim is the realization of an automatic device for strapping bales in fibrous material with a simplified structure with respect to the strapping devices of the prior art.

Finally, the aim of realizing an automatic device for strapping bales in fibrous material capable of being operatively associated with pre-existing presses of multiple types, including vertical overground rotating box presses is also achieved.

The invention claimed is:

1. An automatic strapping device for strapping bales of fibrous material, said automatic strapping device being configured to tie a plurality of straps around a pressed bale formed and pressed by a bale press, said automatic strapping device for strapping bales comprising:

a launching and welding assembly adapted to be arranged at a first side of said bale press, said launching and welding assembly comprising a plurality of launching and welding heads arranged side by side along an axis parallel to said first side of said bale press and orthogonal to a pressing direction of a first pressing plate of said bale press, each of said launching and welding heads comprising:

a first launching and blocking unit configured to receive and block a portion of a strap from a feeding assembly and to wind said portion of said strap around said pressed bale;

a second launching and blocking unit configured to receive, move and block a first end of said portion of said strap following the winding by said first launching and blocking unit;

a welding unit configured to join said first end and a second end of said portion of said strap following their overlapping actuated by a joint action of said first launching and blocking unit and of said second launching and blocking unit, said welding unit being interposed between said first launching and blocking unit and said second launching and blocking unit;

a first arched channel and a second arched channel which develop respectively from said first launching and blocking unit and from said second launching and blocking unit, on opposite sides of said welding unit, in a direction of said bale press;

said launching and welding assembly being configured to assume, with respect to said bale press, when arranged at said first side of said bale press, at least a first position according to which said first arched channel and said second arched channel of each of said launching and welding heads are at least partially inserted in relative through grooves defined respectively along the first pressing plate and a second pressing plate of said bale press;

a rear assembly adapted to be arranged at a second side of said bale press, opposite to said first side, said rear assembly being provided with a plurality of third arched channels equal to a number of said plurality of launching and welding heads, said rear assembly being configured to assume, with respect to said bale press, when arranged at said second side, at least a first position according to which each of said third arched channels has each of its ends at least partially inserted in said through grooves;

when said rear assembly and said launching and welding assembly are arranged in the relative first positions with respect to said bale press, each of said launching and welding heads is coupled to one of said third arched channels so as to define a strapping path around said pressed bale;

said feeding assembly is a single feeding assembly configured to be moved with respect to said launching and welding assembly along an axis, parallel to said first side of said bale press and orthogonally to said pressing direction of said bale press, so that said feeding assembly can be selectively arranged at each of a plurality of inlet ducts of each of said launching and welding heads to feed each of said launching and welding heads with a portion of a strap of predefined length and which is different from or equal to the lengths of the portion of straps supplied to the other launching and welding heads.

2. The automatic strapping device according to claim 1, wherein each of said launching and welding heads comprises one of the plurality of inlet ducts placed upstream of said first launching and blocking unit in order to allow said first launching and blocking unit to receive said portion of said strap from said feeding assembly.

3. The automatic strapping device according to claim 1, wherein said launching and welding assembly is configured to assume, with respect to said bale press, when arranged at said first side of said bale press, also a second position according to which said first arched channel and said second arched channel of each of said launching and welding heads are completely released from said bale press.

4. The automatic strapping device according to claim 3, wherein said launching and welding assembly is configured to be moved with respect to said bale press along a movement direction orthogonal to said first side of said bale press and to said pressing direction so as to be able to translate from said first position to said second position, and vice versa.

5. The automatic strapping device according to claim 4, wherein said launching and welding assembly comprises a supporting frame on which said plurality of said launching and welding heads are mounted, and a pair of rails defined parallel along said movement direction on which said supporting frame is adapted to be moved from said first position to said second position, and vice versa.

6. The automatic strapping device according to claim 5, wherein said feeding assembly is mounted on a truss, slidably coupled to said supporting frame by a pair of rails fixedly arranged on said supporting frame along said axis.

7. The automatic strapping device according to claim 1, wherein said third arched channels are arranged side by side one another along an axis parallel to said second side of said bale press and orthogonal to the pressing direction of said bale press.

8. The automatic strapping device according to claim 1, wherein said rear assembly is configured to assume, with respect to said bale press, when arranged at said second side of said bale press, a second position according to which each of said third arched channels is completely released from said bale press.

9. The automatic strapping device according to claim 8, wherein said rear assembly is rotatably coupled to said bale press according to a rotation axis parallel to said second side of said bale press and orthogonal to said pressing direction so as to be able to pass through a rotation movement from said first position to said second position, and vice versa.

10. The automatic strapping device according to claim 1, wherein said first arched channels, said second arched channels and said third arched channels have a slot at their inner side adapted to be facing said pressed bale, so as to allow an exit of said strap towards said pressed bale, when said strap is at least partially tensioned.

11. The automatic strapping device according to claim 1, wherein said feeding assembly is provided with:

an electric actuator configured to move said strap from a feeding reel towards each of said inlet ducts;

measuring means configured to measure a length of said strap moved by said electric actuator;

cutting means configured to cut said strap once inserted in each of said inlet ducts to a pre-established length;

electronic control means configured to control said electric actuator and said cutting means and to receive as input data acquired by said measuring means.

12. The automatic strapping device according to claim 1, wherein said first launching and blocking unit and said second launching and blocking unit of each of said launching and welding heads each comprise two opposed rollers controlled by an electric actuator to actuate movement of said portion of said strap along a strapping trajectory and to block one of said first end or said second end of said portion of said strap.

13. The automatic strapping device according to claim 1, wherein said welding unit is a vibration-type welding unit.

14. The automatic strapping device according to claim 1, wherein said first launching and blocking unit, said second launching and blocking unit and said welding unit of each of said launching and welding heads are aligned along a strapping trajectory of said portion of said strap around said pressed bale.

15. A system for making bales of fibrous material comprising a bale press for bales of fibrous material associated with an automatic strapping device configured to tie a plurality of straps around a pressed bale formed and pressed by the bale press, wherein said automatic strapping device comprises:

a launching and welding assembly adapted to be arranged at a first side of said bale press, said launching and welding assembly comprising a plurality of launching and welding heads arranged side by side along an axis parallel to said first side of said bale press and orthogonal to a pressing direction of a first pressing plate of said bale press, each of said launching and welding heads comprising:

a first launching and blocking unit configured to receive and block a portion of a strap from a feeding assembly and to wind said portion of said trap around said pressed bale;

a second launching and blocking unit configured to receive, move and block a first end of said portion of said strap following the winding by said first launching and blocking unit;

a welding unit configured to join said first end and a second end of said portion of said strap following their overlapping actuated by a joint action of said first launching and blocking unit and of said second launching and blocking unit, said welding unit being interposed between said first launching and blocking unit and said second launching and blocking unit;

a first arched channel and a second arched channel which develop respectively from said first launching and blocking unit and from said second launching and blocking unit, on opposite sides of said welding unit, in a direction of said bale press;

said launching and welding assembly being configured to assume, with respect to said bale press, when arranged at said first side of said bale press, at least a first position according to which said first arched channel and said second arched channel of each of said launching and welding heads are at least partially inserted in relative through grooves defined respectively along the first pressing plate and a second pressing plate of said bale press;

a rear assembly adapted to be arranged at a second side of said bale press, opposite to said first side, said rear assembly being provided with a plurality of third arched channels equal to a number of said plurality of launching and welding heads, said rear assembly being configured to assume, with respect to said bale press, when arranged at said second side, at least a first position according to which each of said third arched channels has each of its ends at least partially inserted in said through grooves; when said rear assembly and said launching and welding assembly are arranged in the relative first positions with respect to said bale press, each of said launching and welding heads is coupled to one of said third arched channels so as to define a strapping path around said pressed bale;

said feeding assembly is a single feeding assembly configured to be moved with respect to said launching and welding assembly along an axis, parallel to said first side of said bale press and orthogonally to said pressing direction of said bale press, so that said feeding assembly can be selectively arranged at each of a plurality of inlet ducts of each of said launching and welding heads to feed each of said launching and welding heads with a portion of a strap of predefined length and which is different from or equal to the lengths of the portion of straps supplied to the other launching and welding heads.

16. An automatic method for strapping bales in fibrous material by the automatic strapping device according to claim 1, comprising the following steps:

during the pressing operation of said bale by said bale press, arranging said launching and welding assembly and said rear assembly in respective second positions and selectively moving said single feeding assembly with respect to said launching and welding assembly along said axis at each of said inlet ducts of each of said launching and welding heads, so as to arrange at each of said launching and welding heads a portion of said strap of predefined length and which is different from or equal to the lengths of the portion of straps supplied to the other launching and welding heads;

blocking the first end of said portion of said strap by said first launching and blocking unit by each of said launching and welding heads;

at the end of said pressing operation, keeping the bale pressed between the pressing plates of said bale press, arranging said launching and welding assembly and said rear assembly in the respective first positions, so as to define said strapping paths around said pressed bale;

winding each of a portion of straps around said pressed bale, actuating each of said first launching and blocking units of each of said launching and welding heads and receiving and blocking said first end of said portion of wound strap, actuating each of said second launching and blocking units, each of said first launching and blocking units being configured to block said portion of said strap in proximity to said second end;

moving at least said second launching and blocking unit so as to bring said first end and said second end of said portion of said strap in overlap at said welding unit, said portion of strap exiting from slots of said first arched channels, said second arched channels and said third arched channels;

actuating welds of said overlapped first end and second end of each of said portion of said straps by said welding unit;

moving said launching and welding assembly and said rear assembly at the respective second positions so as to be released from said bale press.

* * * * *